US006755098B2

(12) United States Patent
Huang

(10) Patent No.: US 6,755,098 B2
(45) Date of Patent: Jun. 29, 2004

(54) WRENCH

(75) Inventor: Hsiu-Ching Huang, Taipei (TW)

(73) Assignee: Clare Lin, Chang Hua Hsien (TW)

( * ) Notice: Subject to any disclaimer, the term of this patent is extended or adjusted under 35 U.S.C. 154(b) by 0 days.

(21) Appl. No.: 10/144,895

(22) Filed: May 13, 2002

(65) Prior Publication Data

US 2003/0209110 A1 Nov. 13, 2003

(51) Int. Cl.[7] ..... B25B 13/08
(52) U.S. Cl. ..... 81/119; 81/186
(58) Field of Search ..... 81/119, 121.1, 81/186

*Primary Examiner*—D. S. Meislin
(74) *Attorney, Agent, or Firm*—Alan D. Kamrath; Nikolai & Mersereau, P.A.

(57) ABSTRACT

A wrench includes a head and a handle extending from the head in a direction. The head includes two jaws extending from the head in an opposite direction and a throat formed between the jaws. Each of the jaws includes a contact surface for contact with a facet of a head of a bolt. The contact surface of at least one of the jaws includes a plurality of teeth. The throat defines a central recess for receiving a corner of the head of the bolt. The head may define a recess between the throat and each of the jaws. The throat may include two flat contact surfaces for contact with two adjacent facets of the head of the bolt. The central recess defined in the throat is positioned between the flat contact surfaces of the throat.

13 Claims, 4 Drawing Sheets

WRENCH

BACKGROUND OF INVENTION

1. Field of Invention

The present invention relates to a wrench.

2. Related Prior Art

Referring to FIG. 3, a conventional wrench 10 includes a head (not numbered), a handle 11 extending from the head in a direction, and two jaws 12 and 13 extending from the head in an opposite direction. The jaw 12 includes a flat surface 121. The jaw 13 includes a flat surface 131. A throat 14 is formed between the jaws 12 and 13. The throat 14 includes an arched surface (not numbered). In use, the head of the wrench 10 is engaged with a head of a bolt 20. The flat surfaces 121 and 131 contact two facets 21 and 22 of the head of the bolt 20, respectively. Two problems are encountered in use of the wrench 10. Firstly, slipping happens between the flat surface 121 and the facet 21 and between the flat surface 131 and the facet 22. Secondly, a corner 23 between two facets 26 and 27 may be worn out by the arched surface of the throat 14, and corners 24 and 25 by the flat surfaces 121 and 131, respectively.

Referring to FIG. 4, another conventional wrench 30 is devised to eliminate the first problem encountered in use of the wrench 10. The wrench 30 includes a head (not numbered), a handle 31 extending from the head in a direction, and two jaws 32 and 33 extending from the head in an opposite direction. The jaw 32 includes a serrate surface 321. The jaw 33 includes a serrate surface 331. A throat 34 is formed between the jaws 32 and 33. The throat 34 includes an arched surface (not numbered). In use, the head of the wrench 30 is engaged with a head of a bolt 20. The serrate surfaces 321 and 331 contact facets 21 and 22 of the head of the bolt 20, respectively, thus preventing slipping between the serrate surface 321 and the facet 21 and between the serrate surface 331 and the facet 22. However, a corner 23 between two facets 26 and 27 may be worn out by the arched surface of the throat 34, and corners 24 and 25 by the serrate surfaces 321 and 331, respectively.

The present invention is therefore intended to obviate or at least alleviate the problems encountered in prior art.

SUMMARY OF INVENTION

It is an objective of the present invention to provide a wrench for firm engagement with a head of a bolt in use.

It is another objective of the present invention to provide a wrench that protects a head of a bolt in use.

According to the present invention, a wrench includes a head and a handle extending from the head in a direction. The head includes two jaws extending from the head in an opposite direction and a throat formed between the jaws. Each of the jaws includes a contact surface for contact with a facet of a head of a bolt. The contact surface of at least one of the jaws includes a plurality of teeth. The throat defines a central recess for receiving a corner of the head of the bolt.

The head may define a recess between the throat and each of the jaws.

The throat may include two flat contact surfaces for contact with two adjacent facets of the head of the bolt. The central recess defined in the throat is positioned between the flat contact surfaces of the throat.

In a first aspect, the wrench is a directional wrench that is often pivoted in an angular direction from a first one of the jaws through the throat to the second one of the jaws. The first jaw includes a plurality of teeth each including a crown.

The second jaw may include a plurality of teeth each including a crown. The crowns of the teeth formed on the second jaw are larger than the crowns of the teeth formed on the first jaw.

The first jaw may include four teeth. The second jaw may include first, second and third teeth. The crown of the first tooth formed on the second jaw is longer than the crown of the third tooth formed on the second jaw. The crown of the third tooth formed on the second jaw is longer than the crown of the second tooth formed on the second jaw.

In a second aspect, the wrench is non-directional. The contact surface of each of the jaws includes a plurality of teeth.

Other objectives, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings wherein.

DETAILED DESCRIPTION OF PREFERRED EMBODIMENT

Figure 1:
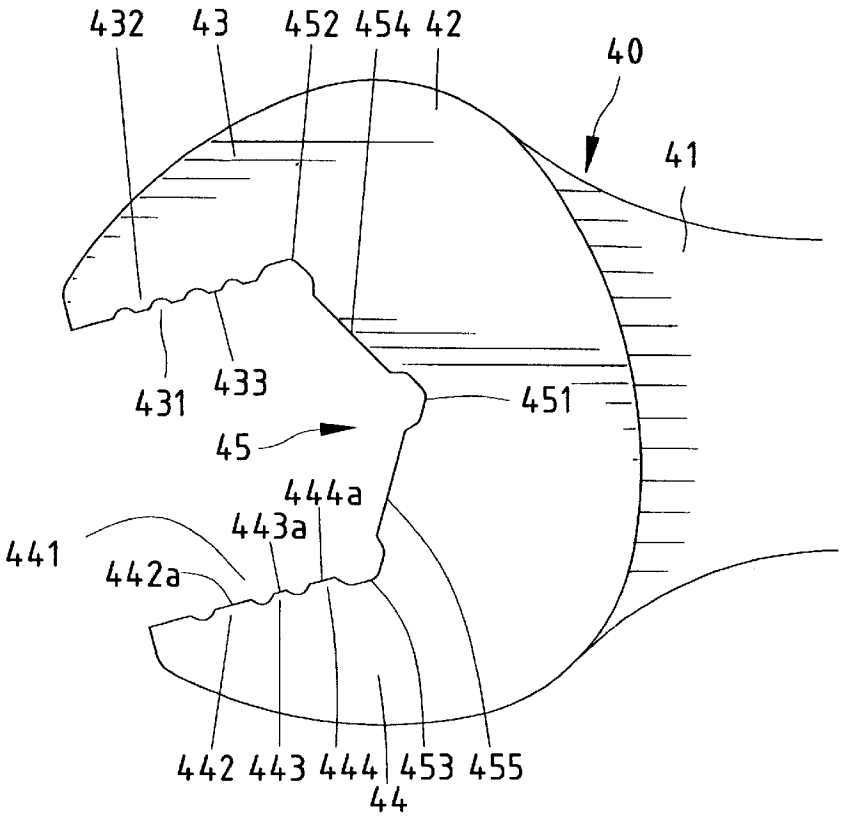
FIG. 1 is a planar view of a wrench according to the present invention.
Figure 2:
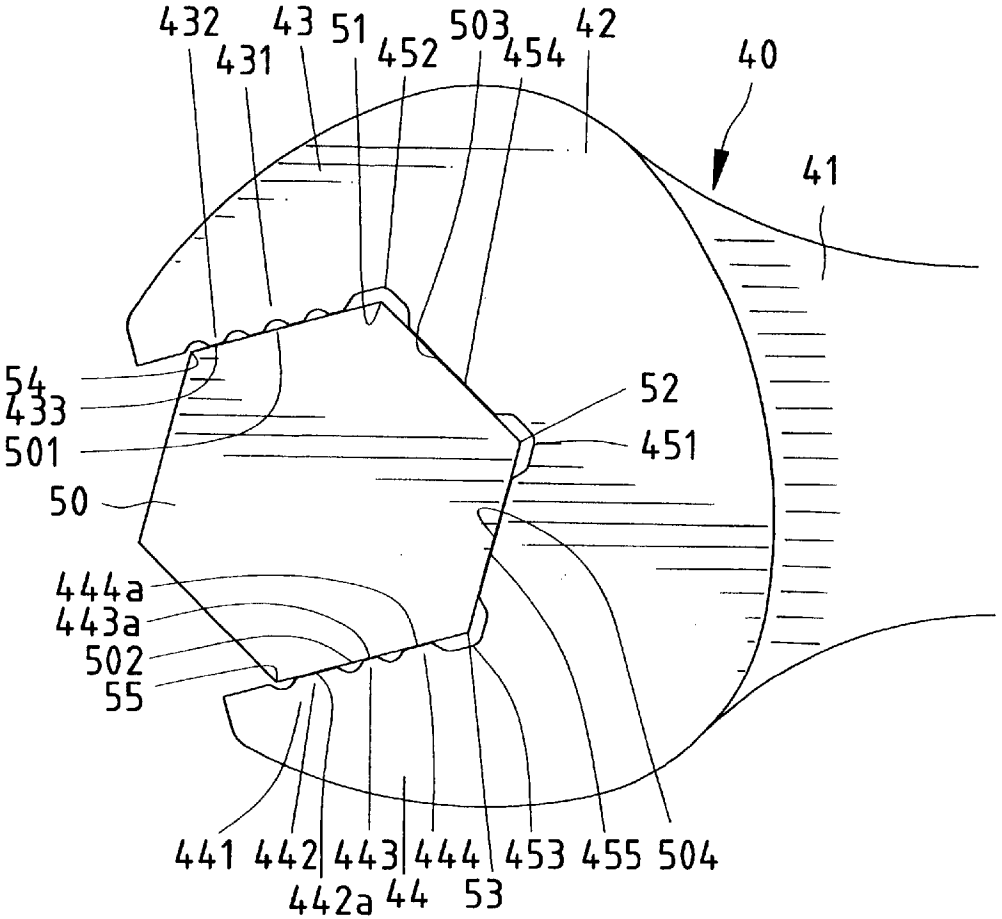
FIG. 2 is a planar view of the wrench shown in FIG. 1 in engagement with a head of a bolt.
Figure 3:
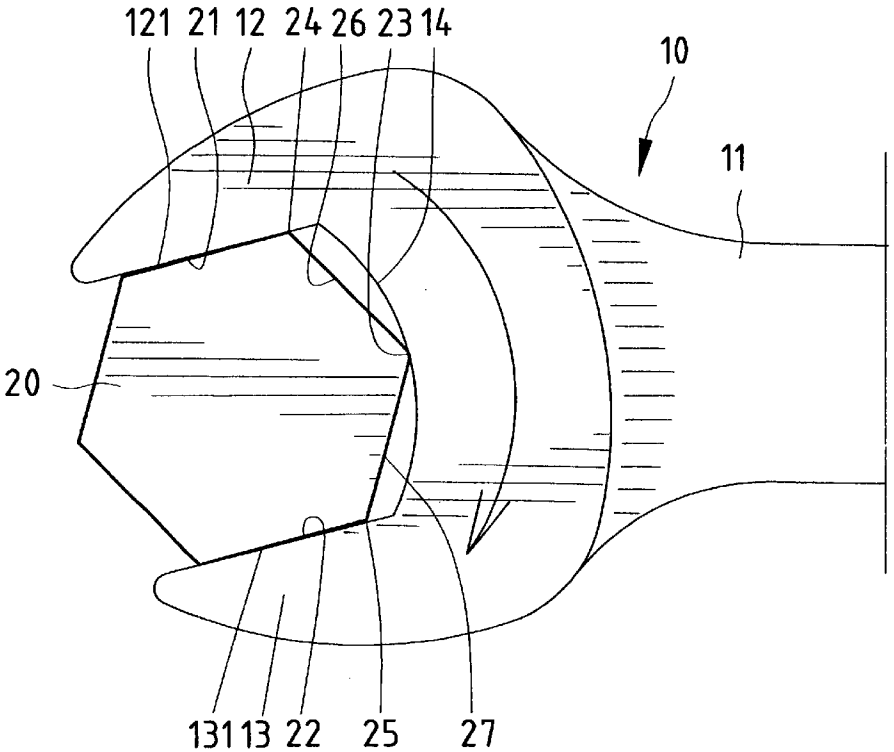
Fig. 3 PRIOR ART
FIG. 3 is a planar view of a conventional wrench engaged with a head of a bolt.
Figure 4:
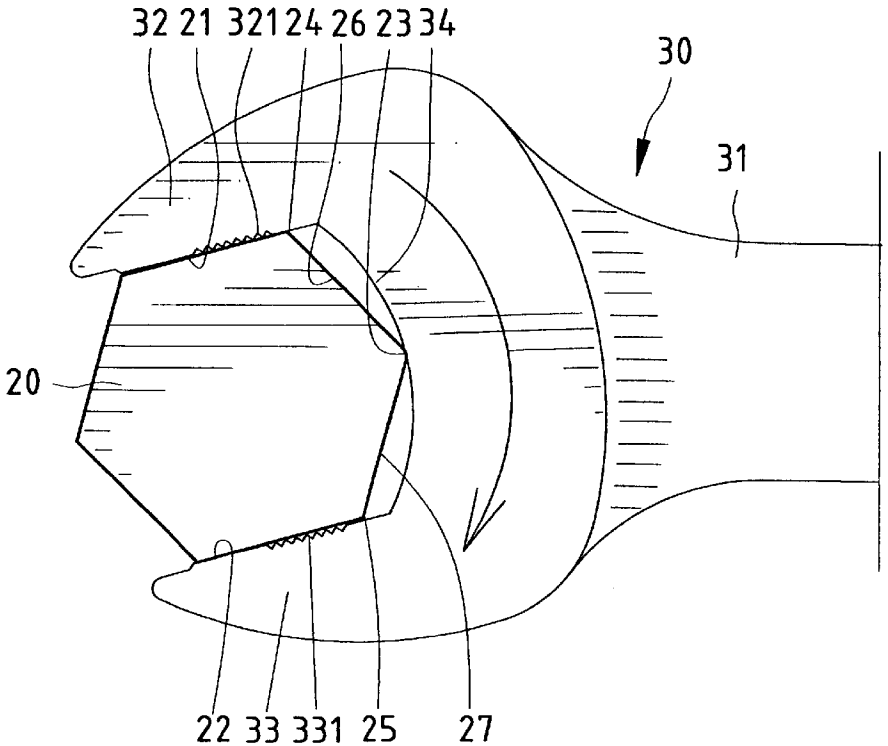
Fig. 4 PRIOR ART
FIG. 4 is a planar view of another conventional wrench in engagement with a head of a bolt.

Referring to FIGS. 1 and 2, a wrench 40 according to the preferred embodiment of the present invention includes a head 42, a handle 41 extending from the head 42 in a direction and two jaws 43 and 44 extending from the head 42 in an opposite direction. A throat 45 is formed between the jaws 43 and 44.

The jaw 43 includes a serrated surface 431 consisting of four teeth 432 each including a crown 433.

Similarly, the jaw 44 includes a serrated surface 441 consisting of a first tooth 442, a second tooth 443 and a third tooth 444. The first tooth 442 includes a crown 442*a*. The second tooth 443 includes a crown 443*a*. The third tooth 444 includes a crown 444*a*. The crown 442*a* of the first tooth 442 is longer than the crown 444*a* of the third tooth 444. The crown 444*a* of the third tooth 444 is longer than the crown 443*a* of the second tooth 443. The crown 443*a* of the second tooth 443 is longer than the crown 433 of each tooth 432.

The throat 45 includes two flat surfaces 454 and 455 corresponding to two adjacent facets of a head of a bolt. The throat 45 defines a recess 451 between the flat surfaces 454 and 455, a recess 452 between the serrate surface 431 and the flat surface 454 and a recess 453 between the serrate surface 441 and the flat surface 455.

FIG. 2 shows a head 50 of a bolt. The head 50 of the bolt includes two parallel facets 501 and 502 and two adjacent facets 503 and 504 between the facets 501 and 502. The head 50 of the bolt includes a corner 51 formed between the facets 501 and 503, a corner 52 between the facets 503 and 504, a corner 53 between the facets 504 and 502 and corners 54 and 55 of facets 501 and 502 opposite to corners 51 and 53.

The head 42 of the wrench 40 can engage with the head 50 of the bolt. The serrate surface 431 engages with the facet 501, the surface 441 with the facet 502, the flat surface 454 with the facet 503, and the flat surface 455 with the facet 504. The corner 51 is positioned in the recess 452, the corner 52 in the recess 451 and the corner 53 in the recess 453.

Thus, slipping between the serrate surface 431 and the facet 501 and between the serrate face 441 and the facet 502 is avoided. The wearing out of the corners 51, 52 and 53 is avoided.

In addition, the wrench 40 is often pivoted in an angular direction from the jaw 43, through the throat 45 to the jaw 44, the serrate surface 431 is often subject to a smaller force than the serrate surface 441 is. The crowns 442*a*, 443*a* and 444*a* are larger than the crowns 433 for providing a greater strength for the serrate surface 441 than for the serrate surface 431.

Furthermore, the flat surface 454 engages with the facet 503, and the flat surface 455 with the facet 504. Thus, the wrench 40 can exert a greater torque on a head of a bolt than a conventional wrench can.

The present invention has been described through detailed illustration of the preferred embodiment. Those skilled in the art can derive many variations from the preferred embodiment without departing from the scope of the present invention. Therefore, the preferred embodiment shall not limit the scope of the present invention. The scope of the present invention is defined in the attached claims.

What is claimed is:

1. A wrench including:

a head including first and second jaws extending from the head in a jaw direction and a throat formed between the jaws, wherein each of the jaws includes a contact surface for contact with a facet of a head of a bolt, the contact surface of each of the jaws including a plurality of teeth each including a crown, with the crowns of the teeth formed on the second jaw being longer than the crowns of the teeth formed on the first jaw; and a handle extending train the head in an opposite handle direction.

2. The wrench according to claim 1 with the throat defining a central recess for receiving a corner of the head of the bolt.

3. The wrench according to claim 2 wherein the head defines a recess between the throat and each of the jaws.

4. The wrench according to claim 2 wherein the throat includes two flat contact surfaces for contact with two adjacent facets of the head of the bolt, and the central recess defined in the throat is positioned between the flat contact surfaces of the throat.

5. The wrench according to claim 1 wherein the handle direction is at an obtuse angle to the jaw direction.

6. The wrench according to claim 1 wherein the second jaw includes first, second and third teeth, the crown of the first tooth formed on the second jaw is longer than the crown of the third tooth formed on the second jaw, the crown of the third tooth formed on the second jaw is longer than the crown of the second tooth formed on the second jaw.

7. The wrench according to claim 6 with the first jaw including four teeth.

8. A wrench including:

a head including first and second jaws extending from the head in a jaw direction and a throat formed between the jaws, wherein each of the jaws includes a contact surface for contact with a facet of a head of a bolt, the contact surface of the second jaw including first, second and third teeth, wherein the crown of the first tooth formed on the second jaw is longer than the crown of the third toot formed on the second jaw, the crown of the third tooth formed on the second jaw is longer than the crown of the second tooth formed on the second jaw; and a handle extending from the head in an opposite handle direction.

9. The wrench according to claim 5 wherein the first jaw includes a plurality of teeth each including a crown.

10. The wrench according to claim 8 with the throat defining a central recess for receiving a corner of the head of the bolt.

11. The wrench according to claim 10, wherein the head defines a recess between the throat and each of the jaws.

12. The wrench according to claim 10 wherein the throat includes two flat contact surfaces for contact with two adjacent facets of the head of the bolt, and the central recess defined the throat is positioned between the flat contact surfaces of the throat.

13. The wrench according to claim 8 wherein the handle direction is at an obtuse angle to the jaw direction.

* * * * *